US006407667B1

(12) United States Patent
Jackson et al.

(10) Patent No.: US 6,407,667 B1
(45) **Date of Patent: *Jun. 18, 2002**

(54) ALARM SYSTEM FOR FORGOTTEN GOLF CLUB

(76) Inventors: Susan M. Jackson; Robert A. Jackson, both of 10100 Hobby Hill Rd., Richmond, VA (US) 23235; John M. Davis, 12418 Queensgate Rd., Midlothian, VA (US) 23113

( * ) Notice: Subject to any disclaimer, the term of this patent is extended or adjusted under 35 U.S.C. 154(b) by 0 days.

This patent is subject to a terminal disclaimer.

(21) Appl. No.: 09/522,650

(22) Filed: Mar. 10, 2000

Related U.S. Application Data

(63) Continuation of application No. 09/161,070, filed on Sep. 25, 1998, now Pat. No. 6,040,772.

(51) Int. Cl.[7] ..... G08B 13/14

(52) U.S. Cl. ..... 340/568.6; 340/539; 340/693.1; 340/571; 340/568.1; 473/282

(58) Field of Search ..... 340/568.1, 568.6, 340/571, 572.1, 539, 693.1, 693.5, 693.9, 636, 567; 206/315.3; 473/408, 283, 282

(56) References Cited

U.S. PATENT DOCUMENTS 5,529,299 A * 6/1996 Bellagamba ..... 473/285
5,565,845 A * 10/1996 Hara ..... 340/568
5,610,585 A * 3/1997 Jobe ..... 340/568
5,689,240 A * 11/1997 Traxler ..... 340/573
5,769,740 A * 6/1998 Colanelo ..... 473/408
5,801,627 A * 9/1998 Hartung ..... 340/568
5,841,352 A * 11/1998 Prakash ..... 340/573
5,844,483 A * 12/1998 Boley ..... 340/568
5,877,686 A * 3/1999 Ibey ..... 340/571
6,040,772 A * 3/2000 Jackson et al. ..... 340/568.6

* cited by examiner

*Primary Examiner*—Anh La

(57) ABSTRACT

An alarm system is provided for alerting a golfer about a forgotten club. A divot tool incorporates a radio transmitter powered by a rechargeable power source for transmitting a coded transmission. A radio receiver tuned to receive the coded transmission includes logic circuitry that generates an alarm signal whenever power associated with the coded transmission drops below a threshold level. One or more alarm devices are coupled to the logic circuitry to generate alarm(s) when the alarm signal is supplied thereto. A power source is coupled to the radio receiver for supplying power thereto and for supplying a charging current for the rechargeable power source via an electrical coupling. When a golfer places a club or other accessory on the ground, the divot tool is placed near the club. As long as the golfer remains within a prescribed range, no alarm will be activated. However, if the golfer moves further from the divot tool than the prescribed range, an alarm is produced. Alerted to his forgetfulness before leaving the vicinity, the golfer then simply retrieves the club and divot tool.

9 Claims, 4 Drawing Sheets

ALARM SYSTEM FOR FORGOTTEN GOLF CLUB

This application is a continuation of Ser. No. 09/161,070 filed on Sep. 25, 1998, and is now U.S. Pat. No. 6,040,772.

FIELD OF THE INVENTION

The invention relates generally to wireless communication, and more particularly to an alarm system that alerts a golfer when he has left an area of the golf course but has forgotten a golf club or other article at that area.

BACKGROUND OF THE INVENTION

When playing golf, players often take more than one club from their bag when they are about to play their next shot. This is because the player is either not certain which club to use for the next shot or is anticipating which club will be needed after the upcoming shot. For example, a player often carries both a club to be used for chipping and his putter when going to play a shot near a green. The club not being used at any given time is then generally laid on the ground. Frequently enough, the player leaves the vicinity without picking up the club(s) on the ground. Unfortunately, recognition of the missing club(s) generally takes place on a later hole or possibly after the day of golf is complete.

Once a club is recognized as being missing, the player must first try to remember where the club was left and then take the time to retrieve same. Assuming the player remembers where the club was left, he must then take the time to go back and get it. When this happens during the round of golf, play on the golf course is slowed. Worse yet, if the player cannot remember where the club was left, he stands the chance of losing a favorite and/or very expensive piece of equipment.

SUMMARY OF THE INVENTION

Accordingly, it is an object of the present invention to provide a system that can be used by a golfer to remind him when he has left a golf club or other accessory behind on the golf course.

Another object of the present invention is to provide a system that alarms a golfer that a club or other accessory has been left behind before the golfer leaves the vicinity.

Other objects and advantages of the present invention will become more obvious hereinafter in the specification and drawings.

In accordance with the present invention, an alarm system for use by a golfer includes a club rest/divot tool incorporating a radio transmitter. The club rest/divot tool is powered by a rechargeable power source for transmitting a coded transmission. A radio receiver tuned to receive the coded transmission includes logic circuitry that generates an alarm signal whenever power associated with the coded transmission drops below a threshold level. At least one alarm device is coupled to the logic circuitry to generate at least one alarm when the alarm signal is supplied thereto. A power source is coupled to the radio receiver for supplying power thereto. An electrical coupling has a first portion mounted on the transmitter and electrically connected to the rechargeable power source. The electrical coupling further has a second portion mounted on the radio receiver and electrically connected to the power source. When the first and second portions are electrically coupled to one another, the rechargeable power source is electrically connected to the power source for receiving a charging current.

When a golfer places a club or other accessory on the ground, the club rest/divot tool is placed near or under the club. As long as the golfer remains within a prescribed range, no alarm will be activated. However, if the golfer moves further from the divot tool than allowed by the prescribed range, an alarm is produced. Alerted to his forgetfulness before leaving the vicinity, the golfer then simply retrieves the club and divot tool.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
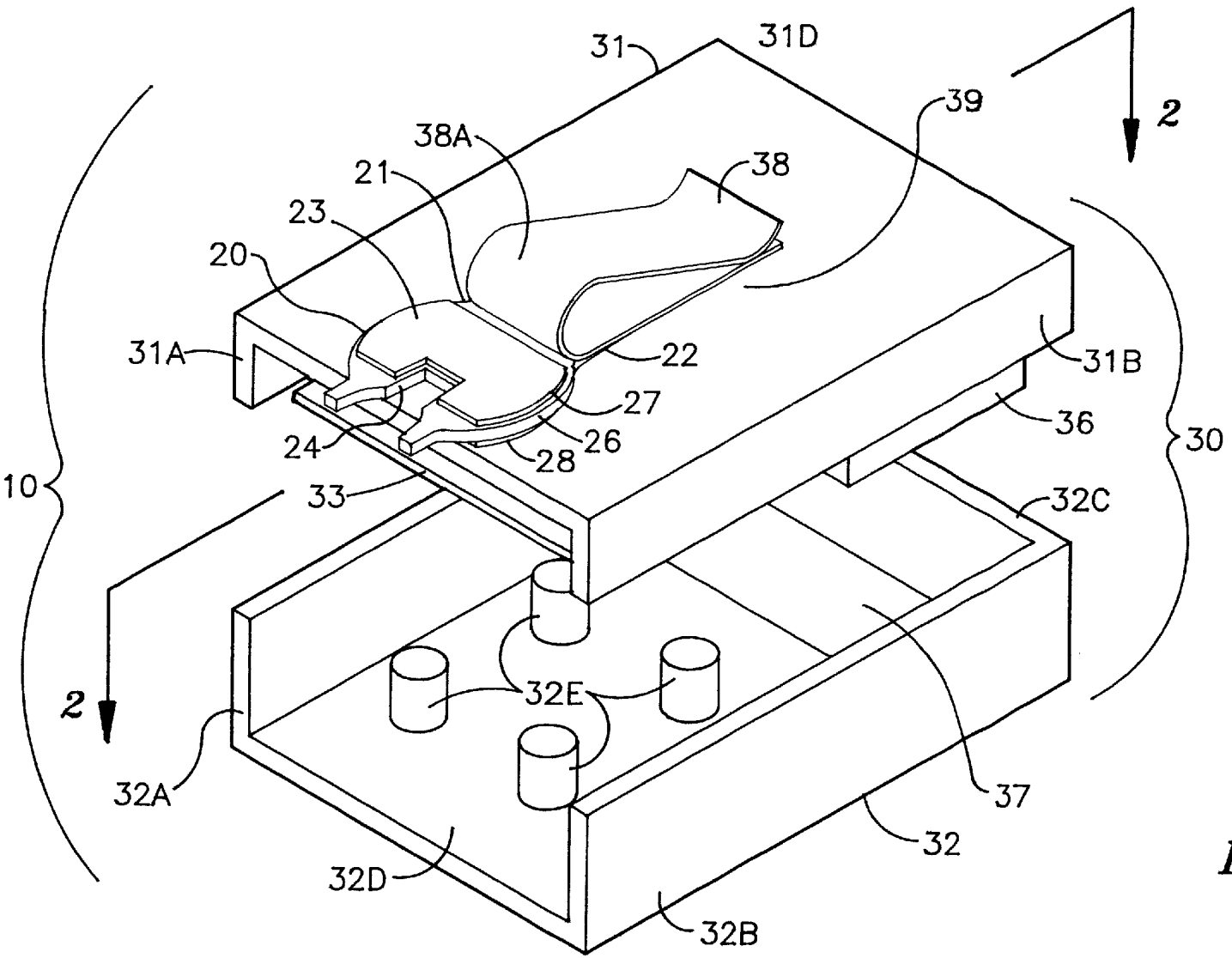
FIG. 1 is an exploded perspective view of the present invention with the transmitting divot tool shown attached to the receiver's housing.

Referring now to the drawings, and more particularly with simultaneous reference to FIGS. 1–4, the mechanical aspects of the present invention will first be described. The alarm system of the present invention is shown in an exploded perspective view and is referenced generally by numeral 10 in FIG. 1. System 10 includes a receiver and a transmitter. The transmitter is housed in a golfer's divot tool 20 that, when not in use, is attached to the receiver portion of system 10 which is referenced by numeral 30. It is to be understood at the outset that FIGS. 1–4 represent one possible mechanical structure for system 10, but that numerous variations are possible without departing from the scope of the present invention.

Divot tool 20 includes divot repair prongs 21 and 22, a main body portion 23 having one side from which prongs 21 and 22 extend, and a cradle 24 shaped like a spike wrench extending from the opposite side of main body portion 23 such that the U-shape of cradle 24 faces in the substantially opposite direction from that of prongs 21 and 22. Note that the specific shape and size of prongs 21/22, main body portion 23 and cradle 24 are not limitations of the present invention.

Divot tool 20 also houses transmission electronics which 4re not shown in FIGS. 1–4, but will be described further below. A central portion 26 between prongs 21/22 and cradle 24 is formed by a printed circuit board supporting the transmission electronics. Sandwiched about and attached to metal portion 26 are caps 27 and 28 made from electrically non-conductive material. A portion of cap 28 is cut away at 29 (FIG. 2) to provide for electrical contact with a metal contact (not shown) on central portion 26 for reasons that will be explained further below.

Figure 4:
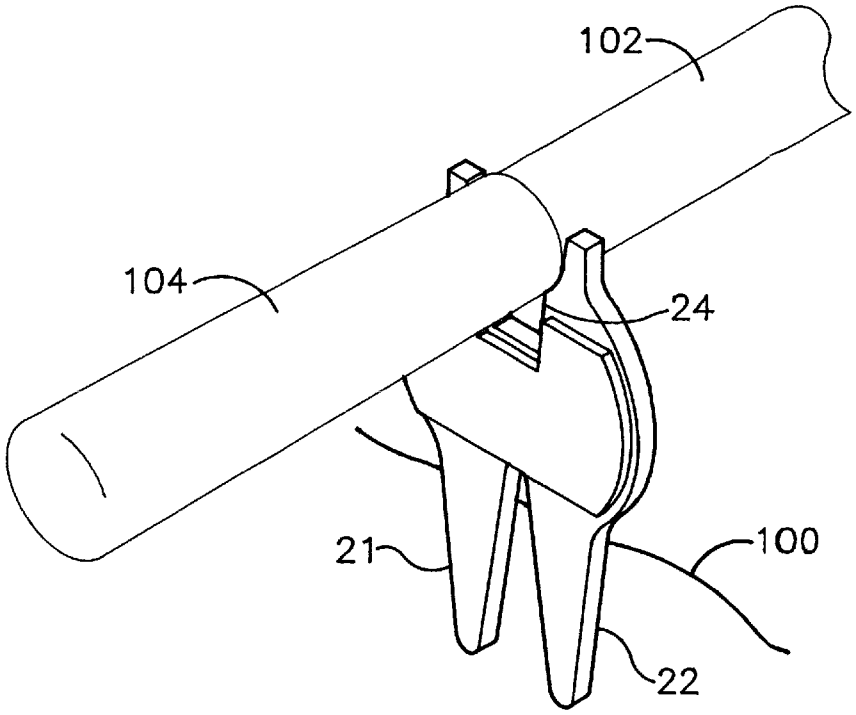
FIG. 4 is an isolated perspective view of the transmitting divot tool being used as a combination transmitter and club rest.

In terms only of its mechanical features, when divot tool 20 is removed from receiver 30, it can be used as a conventional divot tool (i.e., using prongs 21 and 22) as is well understood in the art. However, divot tool 20 can also be used to hold one end of a golf club (e.g., the grip portion of a club) off the ground. This feature is illustrated in FIG. 4 where prongs 21 and 22 are pushed into the ground 100 such that cradle 24 extends up therefrom. The grip portion 104 of a club 102 can then rest in cradle 24 above ground 100. This keeps grip 104 from getting wet and also makes club 102 more visible.

Figure 2:
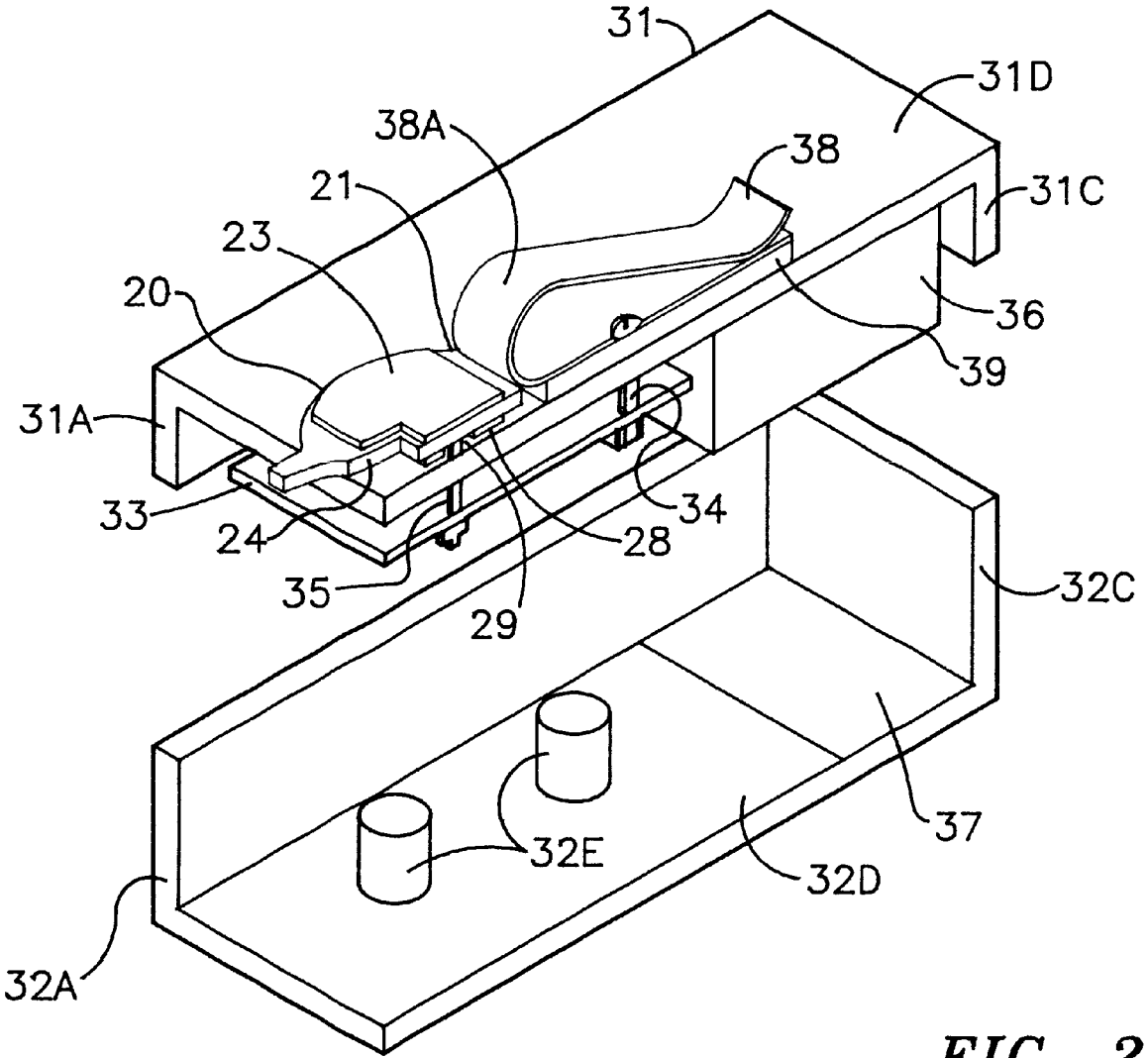
FIG. 2 is cutaway section view taken along lines 2—2 of FIG. 1.
Figure 3:
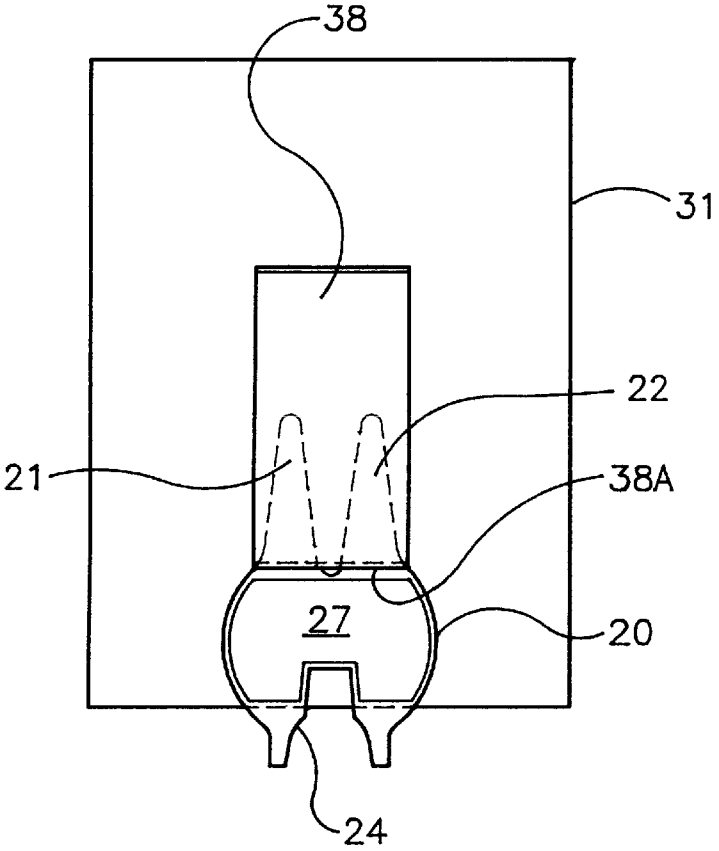
FIG. 3 is a plan view of the present invention showing the transmitting divot tool attached to the receiver's housing.

The mechanical features of receiver 30 will now be described with continued reference to FIGS. 1–3. In the illustrated embodiment, receiver 30 has an upper casing 31 and a lower casing 32 made of a rigid materials. Upper casing 31 has sides 31A and 31B, back 31C and top 31D. Similarly, lower casing 32 has sides 32A and 32B, back 32C and bottom 32D from which circuit board supports 32E can extend. The near ends of casings 31 and 32 have been omitted for clarity of illustration. When placed together, casings 31 and 32 form an outer body for housing the receiver components of system 10.

Mounted in upper casing 31 is a circuit board 33 on which receiver electronics (not shown) are mounted. Circuit board 33 is attached to upper casing 31 by a screw 34 which can also serve as an electrical conductor that conducts electricity from component(s) on circuit board 33 to the exterior of casing 31. A second electrical conductor is provided for conducting electricity from circuit board 33 to the exterior of casing 31. In the illustrated embodiment, this second conductor is a pin 35 electrically coupled to components on circuit board 33 and extending up through casing 31 such that it will make contact with a metal contact on central portion 26 when divot tool 20 is coupled to receiver 30. This is best seen in FIG. 2. One type of device suitable for use as pin 35 is a "pogo" pin which is spring-biased (i.e., upwards towards central portion 26 in this example) to ensure good electrical contact is maintained with the metal contact on central portion 26.

Power for the receiver components is supplied by a standard, user-replaceable battery 36. Mountings for such batteries are well-known in the art and will therefore not be discussed further herein. Access to battery 36 can be achieved either by providing for the separation of casings 31 and 32 or, more typically, by providing an access door 37 in, for example, lower casing 32. Battery 36 will also be used as source of recharging current for a rechargeable power source maintained in divot tool 20.

In use, receiver 30 will be carried or worn by a golfer. To facilitate the wearing of receiver 30, a variety of clothing attachment systems can be employed. For example, receiver 30 could include or incorporate a belt, a snap attachment system and/or some form of hook-and-loop fastener system for attaching receiver 30 to a golfer or his clothing. By way of example, a belt clip 38 is provided and is attached to upper casing 31. More specifically, belt clip 38 is metal and is fixed to casing 31 by screw 34 with the intent that electricity is conducted from circuit board 33 through screw 34 to belt clip 38. The U-shaped portion 38A of belt clip 38 also serves as a means for attaching divot tool 20 to receiver 30. That is, prongs 21/22 fit snugly under U-shaped portion 38A to be retained thereby. To assure the necessary fit, a spacer 39 may be placed between belt clip 38 and upper casing 31. Naturally, spacer 39 could be made an integral part of upper casing 31. Additional mechanical couplings or restraints for divot tool 20 could also be provided on casing 31 if necessary.

Figure 5:
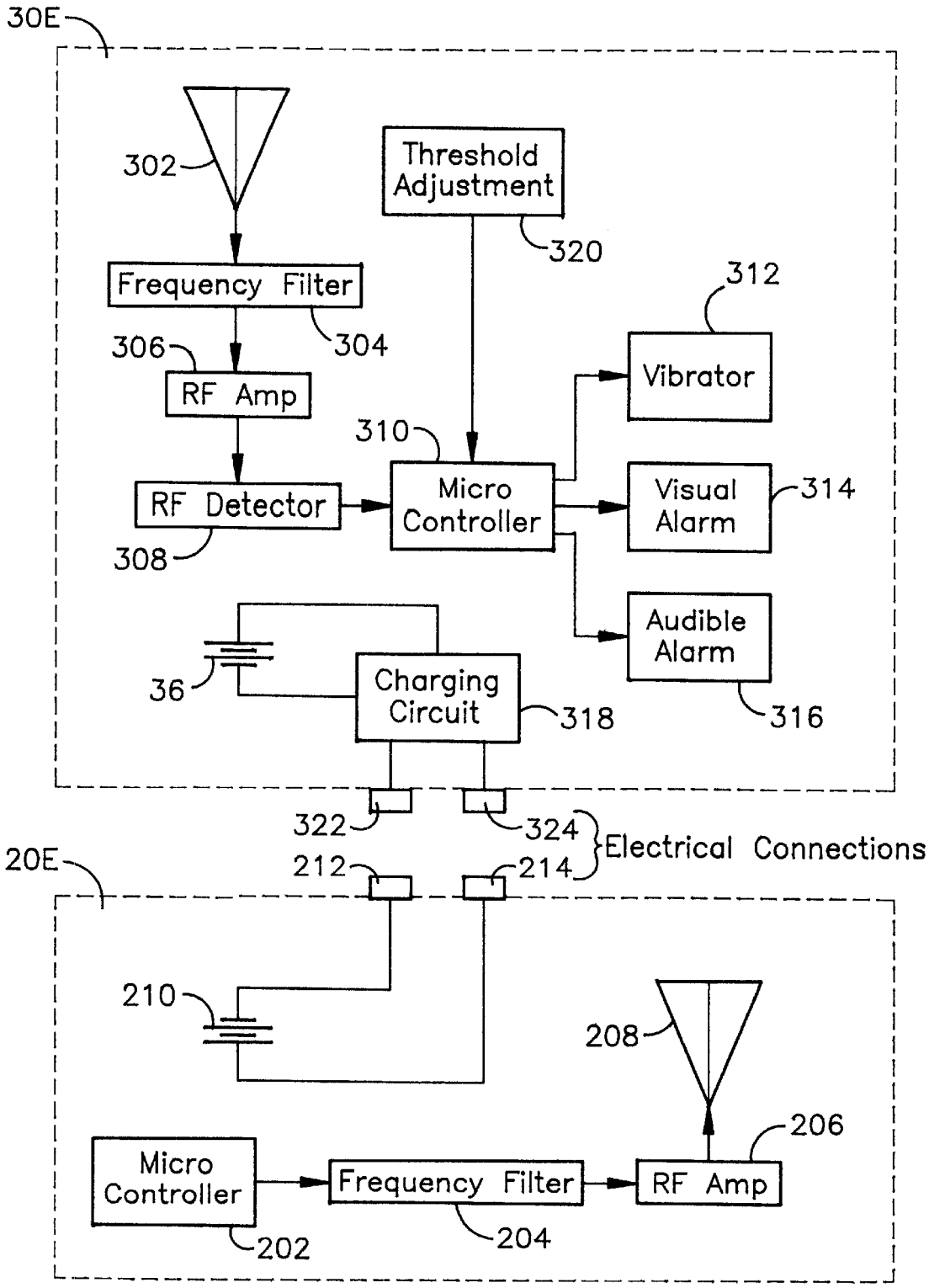
FIG. 5 is a schematic block diagram of the electronic components used in the transmitting divot tool and in the receiver.

The electrical and operational aspects of the present invention will now be explained with reference to FIG. 5 and, where necessary, continued reference to the previous figures. It is to be understood that FIG. 5 represents just one electronic structure for system 10, and that numerous variations are possible without departing from the scope of the present invention. In FIG. 5, the transmitter electronics associated with divot tool 20 are contained within the dashed-line box 20E, and the receiver electronics associated with receiver 30 are contained within the dashed-line box 30E.

Transmitter electronics 20E include a microcontroller 202, a frequency filter 204, an RF amplifier 206, an RF antenna 208, and a power source 210 which is rechargeable in the illustrated embodiment. A voltage applied across electrical connections 212 and 214 will be applied to source 210 in order to recharge same. By way of illustrative example, connections 212 and 214 are realized by a metal contact (not shown) on central portion 26 and prongs 21/22, respectively.

Once activated, microcontroller 202 periodically generates a (digital) code. The code can be unique to the particular transmitter/receiver combination, but need not be as will be explained further below. Frequency filter 204 passes only the code which is then amplified at RF amplifier 206 and transmitted over the airwaves by RF antenna 208. Power for these components is supplied by power source 210.

Receiver electronics 30E includes an RF antenna 302, a frequency filter 304, an RF amplifier 306, an RF detector 308, a microcontroller 310, and one or more alarm devices. The alarm devices could include a vibrator 312, a visual alarm 314 (e.g., a flashing LED or readout), and an audible alarm 316 (e.g., a piezoelectric beeper). Power for these components, and for charging current for power source 210, is supplied by battery 36. A charger circuit 318 may also be required to transform the voltage/current of battery 36 into the voltage/current needs of rechargeable power source 210 and to cut off the charging current when source 210 is fully charged. Such charging circuits are well known in the art.

Once activated, RF antenna 302, frequency filter 304, RF amplifier 306 and RF detector 308 cooperate to "listen" for the coded transmission generated by transmitter electronics 20E. More specifically, the weak RF signal picked up by RF antenna 302 is filtered at filter 304 to detect the carrier frequency of interest. Once amplified at RF amplifier 306, the signal is passed to RF detector 308 to extract the coding from the signal. The detected coded transmission is fed to microcontroller 310 which, for reducing manufacturing costs and simplifying in-field replacement, can be programmed to accept any one of a plurality of acceptable codes. That is, if the coded signal is any one of the acceptable codes, microcontroller 310 is programmed to accept the code from the closest transmitter, i.e., the transmitter producing the strongest signal. When the transmitter is out of range, microcontroller 310 will not be able to accurately detect the code thereby causing one or more of the alarm devices to be activated. Microcontroller 310 could alternatively be programmed to look for a code that is unique to its associated transmitter and/or with a set threshold level. The set threshold level would typically be a power level that is compared with the power level of the detected coded transmission. When the power level drops below the set threshold level such that reception is not accomplished, one or more of the alarm devices would be activated. A time delay can be incorporated to prevent false alarms. Note that adjustment of the set threshold level could be achieved by providing a user-controlled threshold adjustment 320 coupled to microcontroller 310.

The logic employed by the present invention will now be explained. Once system 10 is activated, the distance between divot tool 20 and receiver 30 is monitored. As long as the two devices are within some prescribed distance (e.g., approximately 50 yards), no alarm signal is generated by microcontroller 310. However, whenever divot tool 20 and receiver 30 are separated by more than the prescribed distance (e.g., the coded transmission is no longer detectable or its power level falls below the set threshold level), an alarm signal is output to one or more of vibrator 312, visual alarm 314 and audio alarm 316. The alarm(s) could be activated simultaneously or in some progression as the separation distance increases (i.e., as the power level of the coded transmission decreases). The alarms could be automatically discontinued after some prescribed time out period (e.g., on the order of 15 seconds) as controlled by microcontroller 310, or could require some form of user deactivation. The advantage of the automatic time-out feature is that battery life is preserved.

In operation, a golfer picks up system 10 with divot tool 20 attached to receiver 30. During the time of their attachment, rechargeable power source 210 is receiving a charging current from charger circuit 318. More specifically, charging voltage is made available across the open circuit formed by electrical connections 322 and 324 which, in the illustrated embodiment, are realized by pin 35 and U-shaped portion 38A of belt clip 38. The open circuit across connections 322 and 324 is closed whenever divot tool 20 is attached to receiver 30. Since divot tool 20 will be within the prescribed range of receiver 30, no alarm will be activated.

The golfer removes divot tool 20 and clips receiver 30 to his belt. Typically, divot tool 20 will be placed in the golfer's pocket. Once again, since divot tool 20 and receiver 30 are within the prescribed range, no alarm is activated. When the golfer places a club or other accessory on the ground, divot tool 20 is placed either next to the club or is used to support the club as illustrated in FIG. 4. As long as the golfer remains within the prescribed range, no alarm will be activated. However, if the golfer moves away from divot tool 20 (and the club left therewith) to a distance such that receiver 30 no longer detects the coded transmission from divot tool 20, an alarm signal is produced by microcontroller 310 which, in turn, activates one or more of the alarm devices. Alerted to his forgetfulness before leaving the vicinity, the golfer then simply retrieves the club and divot tool 20. The alarm(s) will be deactivated either as soon as the golfer again is within the prescribed range of receiver 30, when the alarm signal times out, or when the golfer deactivates the alarm(s) and/or system 10.

The advantages of the present invention are numerous. The alarm system alerts a golfer to forgetfulness before he leaves the vicinity where a piece of equipment was left. The receiver is a simple paging device configured to automatically produce an alarm whenever its transmitter (e.g., divot tool 20) is out of range. The transmitter is incorporated into a standard piece of golf equipment so that the golfer need only carry one new item, i.e., receiver 30.

Although the invention has been described relative to a specific embodiment thereof, there are numerous variations and modifications that will be readily apparent to those skilled in the art in light of the above teachings. For example, depending on the physical configuration of divot tool 20, the recharging power source could be maintained on divot tool 20 and the rechargeable power source could be maintained on receiver 30. It is therefore to be understood that, within the scope of the appended claims, the invention may be practiced other than as specifically described.

What is claimed as new and desired to be secured by Letters Patent of the United States is:

1. An alarm system for use by a golfer comprising:

a transmitter device for placing in proximity to a golf club;

a radio transmitter mounted in said transmitter device, said radio transmitter being powered by a rechargeable transmitter power source for transmitting a coded transmission;

a radio receiver tuned to receive said coded transmission, said radio receiver including circuitry that generates an alarm signal whenever power associated with said coded transmission drops below a threshold level;

at least one alarm device coupled to said circuitry for generating at least one golfer-detectable alarm when said alarm signal is supplied thereto;

a receiver power source coupled to said radio receiver for supplying power thereof; and an electrical coupling having a first portion mounted on said radio transmitter and electrically connected to said transmitter power source, said electrical coupling further having a second portion mounted on said radio receiver and electrically connected to said receiver power source wherein, when said first portion and said second portion are electrically coupled to one another, said transmitter power source is electrically connected to said receiver power source for receiving a charging current.

2. An alarm system as in claim 1 further comprising a housing containing said radio receiver said at least one alarm device, said receiver power source and said second portion of said electrical coupling and an attachment coupled to said housing for allowing said housing to be worn by said golfer.

3. An alarm system as in claim 1 wherein said electrical coupling includes a mechanical coupling for retaining said transmitter device relative to said radio receiver when said first portion and said second portion are electrically coupled to one another.

4. An alarm system as in claim 1 wherein said at least one alarm device is selected from the group consisting of an audio alarm device, a visual alarm device and a vibration alarm device.

5. An alarm system as in claim 1 wherein said at least one alarm device comprises an audio alarm device and a visual alarm device.

6. An alarm system as in claim 1 wherein said receiver power source is a replaceable power source.

7. An alarm system as in claim 1 wherein said threshold level is set such that said alarm signal is generated whenever said radio transmitter and said radio receiver are separated by approximately 50 yards.

8. An alarm system as in claim 1 further comprising an adjuster coupled to said circuitry, said adjuster providing for adjustment of said threshold level.

9. An alarm system as in claim 1 wherein said transmitter device has a divot repair portion formed on one end thereof and a cradle portion formed on the opposing end thereof wherein, when said divot repair portion is stuck into the ground, said cradle portion extends substantially upward from the ground.

* * * * *